US006602008B2

(12) United States Patent
Yamagishi et al.

(10) Patent No.: US 6,602,008 B2
(45) Date of Patent: Aug. 5, 2003

(54) PRINT-MEDIUM TRANSPORT UNIT

(75) Inventors: Kazuhiko Yamagishi, Nagano (JP); Kotoya Aruga, Nagano (JP); Hiroshi Takizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 113 days.

(21) Appl. No.: 09/835,065

(22) Filed: Apr. 16, 2001

(65) Prior Publication Data

US 2002/0021929 A1 Feb. 21, 2002

(30) Foreign Application Priority Data

May 17, 2000 (JP) ..... 2000-145333
Jun. 20, 2000 (JP) ..... 2000-185163
Mar. 30, 2001 (JP) ..... 2001-101627

(51) Int. Cl.[7] ..... B41J 11/00

(52) U.S. Cl. ..... 400/619; 400/600; 400/611; 400/642; 271/236

(58) Field of Search ..... 400/621, 600, 400/600.2, 600.4, 611, 642, 664, 619, 645.4, 645; 271/236

(56) References Cited

U.S. PATENT DOCUMENTS 4,360,279 A * 11/1982 Sugiura ..... 271/228
5,362,041 A 11/1994 Ryuzaki et al.
5,820,282 A * 10/1998 Nakai ..... 347/104
5,954,438 A * 9/1999 Klein et al. ..... 101/226
6,092,949 A * 7/2000 Koyabu et al. ..... 400/642
6,149,327 A * 11/2000 Ward et al. ..... 347/14
6,334,723 B1 * 1/2002 Trovinger et al. ..... 271/258.05
6,428,226 B1 * 8/2002 Suzuki et al. ..... 400/619

FOREIGN PATENT DOCUMENTS

| | | |
|---|---|---|
| EP | 1 004 452 | 5/2000 |
| JP | 1-181659 | 7/1989 |
| JP | 7-304540 | 11/1995 |
| JP | 8-113393 | 5/1996 |
| JP | 9-142708 | 6/1997 |
| JP | 11-79468 | 3/1999 |
| WO | WO 99/10181 | 3/1999 |

OTHER PUBLICATIONS

Patent Abstracts of Japan, vol. 2000, No. 01, Jan. 31, 2000 and JP 11 291574 A (Copyer Co Ltd).

* cited by examiner

*Primary Examiner*—Stephen R. Funk
*Assistant Examiner*—Dave A. Ghatt
(74) *Attorney, Agent, or Firm*—Nixon & Vanderhye P.C.

(57) ABSTRACT

A print-medium transport unit including discharge rollers, a paper guide, and a lock member. The discharge rollers transport post-printed paper toward an outlet and can hold the leading end of the paper. The paper guide is placed upstream from the discharge rollers, and guides the leading end of the paper into the discharge rollers. The paper guide is rotatably supported so that the upstream side thereof opens a transport path of the paper, whereby when the leading end of the paper is held by the discharge rollers, the transport path allows the paper to be curved like a loop. The lock member locks the rotation of the paper guide when the leading end of the paper is guided into the paper guide. When the leading end of the paper reaches a predetermined position, the locking of the lock member is released.

20 Claims, 15 Drawing Sheets

PRINT-MEDIUM TRANSPORT UNIT

BACKGROUND OF THE INVENTION

This invention relates to a transport unit for transporting print medium, and in particular to a transport unit placed in a paper discharge section of a printer for handling long print paper.

A printer contained in an apparatus installed in an environment with no humans in attendance or an environment in which the operator cannot frequently replace paper, such as an ATM (automated-teller machine) or a POS (point-of-sale) cash resister is known. Printers of this type typically print on continuous paper, such as rolled paper, and then cut the paper with a cutter mechanism, after which the cut paper is discharged. These printers are widely used for the purpose of reducing, as much as possible, the frequency of paper replacement.

In this kind of printer, discharge control of paper is important. In a normal printer, the leading end of paper—after print termination or during a printing operation—is discharged through an outlet to the outside of the cabinet by the paper feed operation accompanying the printing operation. However, if the user attempts to pull on the paper being discharged from the outlet before the paper is cut by the cutter mechanism, it causes a print failure or a paper jam to occur.

To prevent such a problem, in a related art paper discharge unit used with a printer, for example, as disclosed in Japanese Patent Publication No. 9-142708A, paper feeding, with a discharge roller placed in the proximity of an outlet, is temporarily stopped during the printing operation, the paper is curved like a loop in the paper discharge unit to preventing a leading end of the paper from extending through the outlet, and after the printing operation is terminated, the paper feeding is restarted to discharge the paper. To curve the paper, the paper discharge unit comprises a paper guide, which normally guides the paper straight toward the discharge roller, but which, when the paper feed stops, is displaced such that the paper is curved like a loop at a predetermined space upstream of the discharge roller.

The above paper guide is formed of an elastic plate made up of a synthetic resin plate, a thin metal plate, etc., with an end part on the discharge roller side fixedly secured. The leading end part of printed paper is guided toward the discharge roller, and the transport force of the paper bends the paper guide, so that the paper is curved like a loop and is retained in the predetermined space.

As another example, a paper guide can be rotated with an end part on the discharge roller side as a supporting shaft. In this case, the paper guide may be moved as transported paper is curved (Japanese Patent Publication No. 11-79468A, for example) or may be moved by an actuator such as a solenoid (Japanese Patent Publication No. 1-181659A, for example).

However, in the related art configuration, wherein one end of the paper guide is fixedly secured and paper is curved like a loop by the elastic force of the paper guide, the strength of the paper guide must be increased for suppressing the bending amount to improve the paper guide's ability to guide paper into the discharge roller. On the other hand, the strength of the paper guide must be lowered to provide a sufficient bending amount to stably curve the paper. That is, the function of reliably guiding the leading end part of printed paper toward the discharge roller, and the function of curving the paper so that the curved paper is retained in the predetermined space, are mutually exclusive.

In the related art configuration, wherein the paper guide can be configured to curve paper by rotating it with one end thereof as the supporting shaft, if a "peculiarity" exists at the leading end of paper sent from the print section, the paper guide is irregularly rotated because of the transport force and the peculiarity. Thus, the paper is not well guided into the discharge roller and enters the outside of the transport path, causing a paper jam to occur.

SUMMARY OF THE INVENTION

It is, therefore, an object of the invention to provide a transport unit that can reliably guide paper into an outlet even if the leading end of the paper has a "peculiarity" or the like, thereby circumventing transport trouble of a paper jam, or the like.

In order to achieve the above object, according to the present invention, there is provided a transport unit, for transporting a print medium, comprising:

- a guide member, that forms at least a part of a transport path through which the print medium is transported;
- a support member, that supports the guide member so as to be movable between a first position at which the guide member forms the transport path and a second position at which the guide member opens the transport path; and
- a lock member, which locks the support member at the first position.

In this configuration, since a movement of the guide member is locked when the leading end of the print medium is guided into the guide member, even if a "peculiarity" or the like occurs at the leading end of the print medium, the print medium is guided through the transport path smoothly and reliably. When the print medium is bent due to the transporting force, the guide member is unlocked so that the print medium can be curved like a loop and stored in a predetermined space. That is, the guide member is switched between the locked state in which the print medium can be reliably guided into the transport path, and the unlocked state in which the print medium can be curved like a loop.

Preferably, the transport unit further comprises a moving mechanism that moves at least one of the guide member and the lock member between a third position and a fourth position. The guide member includes a first engagement member, and the lock member includes a second engagement member. The first engagement member and the second engagement member are engaged with each other at the third position, and are separated from each other at the fourth position.

Here, it is preferable that the first engagement member is provided as a pair of engagement members arranged on the guide member at both widthwise sides of the print medium. The second engagement member is provided as a pair of engagement members arranged on the lock member at both widthwise sides of the print medium.

Also, it is preferable that the transport unit further comprises:

- an outlet, from which the print medium is discharged;
- a first transport roller, which transports the print medium toward the outlet, in the transport path at a downstream side of the guide member;
- a controller, which controls the moving mechanism to move the at least one of the guide member and the lock member toward the third position to lock the guide member, when a leading end of the print medium reaches the guide member, and controls the moving mechanism to move the at least one of the guide member and the lock member toward the fourth position to unlock the guide member, when the leading end of the print medium reaches in the vicinity of the first transport roller.

In this configuration, switching of the guide member between the locked state and the unlocked state can be controlled electrically.

In this case, it is preferable that the transport unit further comprises a second transport roller, which transports the print medium toward the guide member, in the transport path at an upstream side of the guide member. The controller determines a timing to move the at least one of the guide member and the lock member based on a rotation amount of the second transport roller.

Also, it is preferable that the lock member is rotatably supported at an upstream side of the first transport roller. The lock member includes a path switcher that is placed in the transport path to lead a rear end of the print medium toward another transport path, when the first transport roller transports the print medium backward.

In this configuration, if the print medium discharged through the outlet is not removed, the print medium can be fed backward and can be collected.

Preferably, the support member rotatably supports the guide member such that a portion of the guide member placed in an upstream side of the transport path opens the transport path.

Here, it is preferable that the lock member is arranged to face the guide member so as to form, together with the guide member, the transport path. The guide member is formed with a first slot that extends in a direction substantially perpendicular to the transport path. The support member includes a shaft member that is engaged with the first slot to rotatably support the guide member. And the moving mechanism includes the first slot and the shaft member.

In this configuration, the guide member can be switched between the locked state and the unlocked state using the thickness of the transported print medium, and can be switched according to a simple structure without using a power source.

The first slot may be replaced with a groove and the shaft member may be replaced with a projection.

Here, it is preferable that the moving mechanism further includes a first urging member that urges the guide member toward the lock member.

In this configuration, if the print medium does not exist in the proximity of the engagement part, the guide member reliably can be locked.

Also, it is preferable that a gap is formed between the guide member and the lock member at the third position such that the narrowest part of the gap is narrower than a thickness dimension of the print medium. An engagement margin is provided, between the first engagement member and the second engagement member at the third position, so as to be smaller than the thickness dimension of the print medium.

Still also, it is preferable that the guide member includes an engagement releaser that is protruded toward the transport path. The first engagement member is formed on the guide member so as not to be protruded from an outer peripheral face of the engagement releaser. Also, the lock member is formed with a recess which houses the engagement releaser and the first engagement member, being formed with side walls. The second engagement member is provided as one of the side walls forming the recess.

Alternatively, the lock member is formed with a first housing member which houses the engagement releaser, and a second housing member which houses the first engagement member. The second engagement member is provided as one of side walls formed with the second housing member.

In this configuration, the locked guide member can be unlocked independently of the thickness of the print medium.

Preferably, the transport unit further comprises a reliever that moves the guide member through use of a force acting between the first engagement member and the second engagement member to rotate the guide member when the first and second engagement members are placed in the third position. The reliever moves the guide member by displacing the shaft member toward a downstream side of the transport path.

In this configuration, if the guide member needs to be rotated for opening the transport path for maintenance of a paper jam, for example, the guide member can also be unlocked while the force acting on the engagement part of the guide member and the lock member is relieved, so that damage to the engagement part is prevented.

Also, it is preferable that the reliever is formed with a bearing member that supports the shaft member movably therein.

Further, it is preferable that the bearing member is provided as a second slot which extends in substantially parallel with the transport path.

Moreover, it is preferable that the reliever includes a second urging member that urges the first engagement member toward the third position.

Preferably, the print medium is provided as continuous paper. Alternatively, long cut sheets may be provided as the print medium.

According to a preferred embodiment, the guide member rotates as print medium is transported, so that a part of the medium is always in contact with the guide member and if the guide member is provided with a member for regulating the widthwise position of the medium, a skew of the print medium is during the transporting can be prevented, so that stable transporting can be accomplished.

According to the present invention, there is also provided a printer comprising the above transport unit.

Also, according to the present invention, there is provided a control method used in the above transport unit, comprising the steps of:

rotating the second transport roller to transport the print medium;

driving the lock member to lock the guide member; and driving the lock member to unlock the guide member, when the leading end of the print medium reaches in the vicinity of the first transport roller.

According to the present invention, there is also provided a computer program executed by the controller in the above transport unit, comprising the above-noted steps.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Referring now to the accompanying drawings, there are shown preferred embodiments of the invention.

Figure 1:
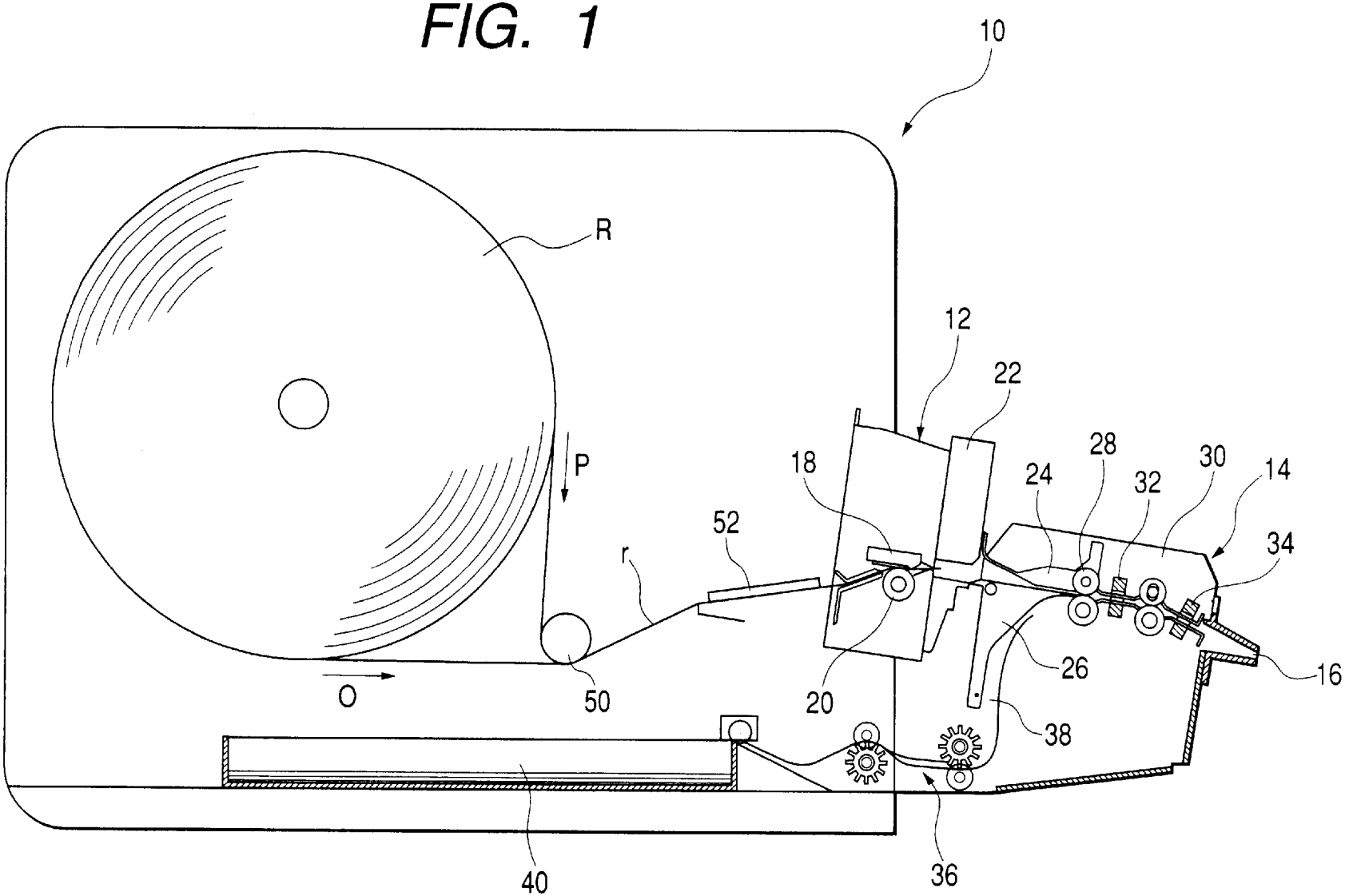
FIG. 1 is a schematic side view showing the internal structure of a printer having a paper discharge unit according to a first embodiment of the invention.

FIG. 1 is a schematic side view showing the internal structure of a printer comprising a transport unit according to a first embodiment of the invention. A printer 10 is a printer for printing receipts, installed in an ATM, etc., and stores rolled paper R as continuous paper. A print section 12 is placed in the printer 10, and a paper discharge unit 14 is installed adjacent to and downstream of the print section 12. A paper end r, drawn out from the rolled paper R, is passed through a transport path that extends through the print section 12 and the paper discharge unit 14, whereby the paper end r is discharged through an outlet 16 to the outside of a cabinet.

Although not shown, the paper discharge unit 14 is attached to the printer so that it can be guided in a guide groove of a base frame through a guide pin to expose the print section 12, thereby enhancing ease of maintenance in the print section 12 and the paper discharge unit 14.

A print head 18 of a thermal-type, for example, a platen roller 20—also serving as a paper feed roller—and a cutter mechanism 22, are placed in the print section 12 and on the transport path. A paper guide 24, a path switcher 26, and discharge rollers 28 and 30, are placed in the paper discharge unit 14. The transport rollers—including platen roller 20, and discharge rollers 28 and 30—are driven appropriately in accordance with a print instruction from a host, and the rolled paper R is drawn out from the roll portion.

The rolled paper R, of heat-sensitive paper, has only one printable side to which color coupler is applied, which will be hereinafter referred to as the print side; the rolled paper R may be wound with the print side as the outside or may be wound with the print side as the inside. To deal with the two types of rolled paper R, the printer 10 comprises a guide roller 50. The rolled paper R with the print side as the outside is set as "P" in FIG. 1, whereas the rolled paper R with the print side as the inside is set as "O" in FIG. 1.

The rolled paper R, drawn out through the guide roller 50, is regulated in the width direction of the rolled paper R by a guide plate 52, and is introduced into the print section 12. The print section 12 comprises a paper sensor (not shown), located upstream from the platen roller 20, for sensing whether or not the rolled paper R is conveyed into the print section 12. For example, the paper sensor can be made up of a shutter lever, rotated in response to the presence or absence of the rolled paper R, and of a transmission photosensor.

The rolled paper is fed by the platen roller 20, and the print head 18 is driven for printing any desired characters, symbols, etc., on the print surface. The region drawn out from the rolled paper R that is printed is further transported toward the outlet 16. When the rear end part of the printed region comes to the position of the cutter mechanism 22, the paper sheet is cut and separated by the cutter mechanism 22 so that it is supplied to the user as a cut-sheet receipt.

The discharge rollers 28 and 30 receive the leading end r of the rolled paper R fed by the platen roller 20, and introduce it into the outlet 16. A belt is placed on the discharge rollers 28 and 30, and a driving force from a step motor is transmitted through gears. The transport speed of the rolled paper R by the discharge rollers 28 and 30 is set to substantially the same as that in the platen roller 20. Therefore, a tensile force is not applied to, or needless bend does not occur on, the rolled paper R that is fed by the platen roller 20 and has its leading end between the discharge rollers 28 and 30, when the platen roller 20 and the discharge rollers 28 and 30 are driven.

The leading end portion r of paper is separated from the upstream portion of the rolled paper R by the cutter mechanism 22, thereby forming a cut paper, and is continuously transported by the discharge rollers 28 and 30 so that a front region of the cut paper is sent through the outlet 16 to the outside of the printer. The downstream discharge rollers 30 clamp the paper r with a pressure weaker than that of the upstream discharge rollers 28. The rear end of the cut paper is finally held between the downstream discharge rollers 30. Since the cut paper is thus held by the weak force of the discharge rollers 30, the user can easily pull out the cut paper. As for control according to the invention, the discharge rollers 28 and 30 can be driven and stopped independently of the platen 20.

The printer 10 also comprises a paper sensor 32, between the two pairs of the discharge rollers 28 and 30, and a paper sensor 34 at the downstream of the discharge rollers 30. When the rolled paper R is transported, and the leading end thereof exceeds the upstream discharge rollers 28, the upstream paper sensor 32 senses such fact. Also, when the rear end part of the cut paper exceeds the discharge rollers 28, the upstream paper sensor 32 senses such fact. Control is executed in various manners based on signals from the upstream paper sensor 32. The downstream paper sensor 34 detects the presence or absence of a receipt held on the discharge rollers 30.

The printer 10 further comprises a collection unit 36 that collects cut and separated receipts (cut papers). If the downstream paper sensor 34 senses that a receipt is left standing in the outlet 16 for a predetermined time period, the discharge rollers 28 and 30 feed the receipt backward, and pull the receipt into the paper discharge unit 14 based on an instruction from the host. The receipt pulled into the paper discharge unit 14 is transported into a collection path 38 by the operation of the path switcher 26 (described later), and subsequently is collected in a collection tray 40.

A control CPU (Central Processing Unit) not shown and ROM (Read-Only Memory, not shown) are installed in the printer 10. The CPU installed in the printer 10 controls the above-described mechanical parts of the printer 10 in accordance with a control command from the host computer and a control program stored in the ROM. In relation to the invention, the CPU contained in the printer 10 controls driving the platen roller 20, the discharge rollers 28 and 30, and the cutter mechanism 22, for accomplishing a predetermined paper discharge operation.

Figure 2:
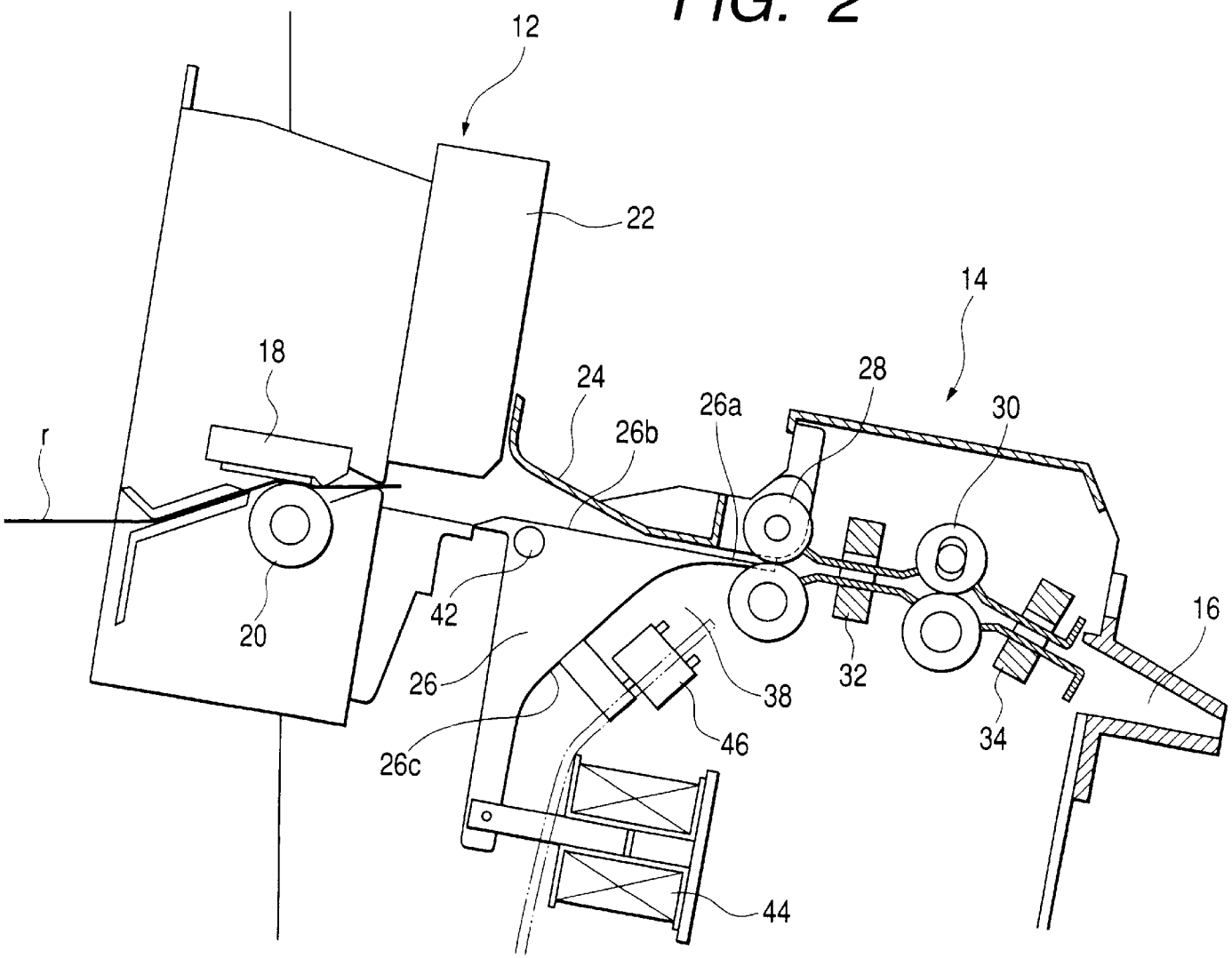
FIG. 2 is an enlarged view of an essential part in FIG. 1, and shows the paper discharge unit.

FIG. 2 is an enlarged view of an essential part in FIG. 1, and shows the paper discharge unit 14. As described above, the paper discharge unit 14 is placed downstream from the print section 12. The paper guide 24, the path switcher 26, the discharge rollers 28 and 30, and the paper sensors 32 and 34, are placed on the transport path of the paper discharge unit 14.

The paper guide 24 is positioned upstream from the discharge rollers 28, and guides the leading end r of the rolled paper R to the discharge rollers 28. The paper guide 24 is rotatably supported relative to the shafts of the discharge rollers 28 such that a shaft of the paper guide 24 and the discharge rollers 28 are coaxial. The upstream side of the paper guide 24 is lifted upward. However, the rotation shaft of the paper guide 24 may be provided independently of the rotation shafts of the discharge rollers 28. The paper end r is once stopped by the discharge rollers 28 in the process of discharging the rolled paper R, as described later. In this state, if the rolled paper R is continuously transported by the platen roller 20, it is curved upward like a loop upstream of the discharge rollers 28. Since there is adopted a mechanism for rotatably supporting the paper guide 24, the paper guide 24 rotates upward thereby opening the upper part of the transport path so as to allow the loop to be formed. The paper guide 24 is formed of a resin material, for example, and the upstream end of the paper guide 24 is open to the side of the print section 12 so that the rolled paper R reliably can be guided above the transport path.

The path switcher 26, together with the paper guide 24, guides the leading end r of the rolled paper R from the print section 12 to the discharge rollers 28, whereas, when the cut paper that once exceeded the discharge rollers 28 is fed backward, the path switcher 26 guides the cut paper toward the collection path 38. That is, the path switcher 26 can be slightly rotated on a shaft 42 so that a leading end part 26*a*, made to face the discharge rollers 28, can be advanced to and retreated from the transport path under the rotation control of a solenoid 44.

When the solenoid 44 is turned off, the leading end part 26*a* of the path switcher 26 is moved down, whereby the transport path is opened, making it possible to introduce the leading end r of the rolled paper R into the discharge rollers 28. On the other hand, when the solenoid 44 is turned on, the leading end part 26*a* is moved up, thereby making it possible to guide the cut paper, fed backward from the downstream side of the discharge rollers 28, into the collection path 38. In this state, a micro switch 46 is pressed by the path switcher 26 so that this state is detected by the CPU. An upper face 26*b* of the path switcher 26 is opposed to the paper guide 24, and functions as a paper guide for guiding the rolled paper R to the discharge rollers 28. An inclined lower face 26*c* of the path switcher 26 serves as a paper guide for the cut paper guided along the collection path 38.

Figure 3A:
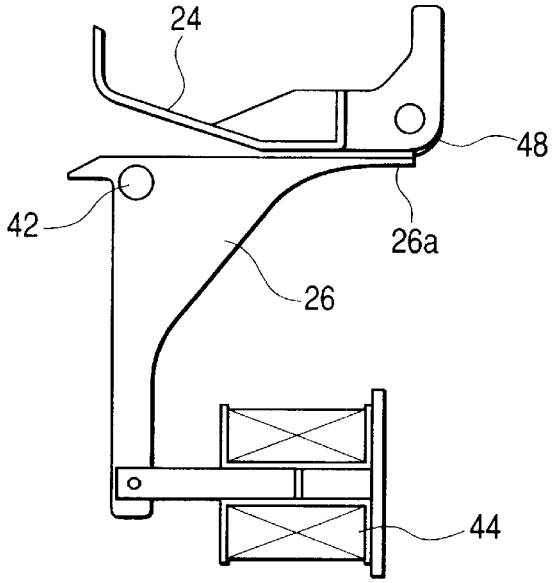
FIGS. 3A and 3B respectively are a side view and a plan view showing a lock mechanism of a paper guide.
Figure 3B:
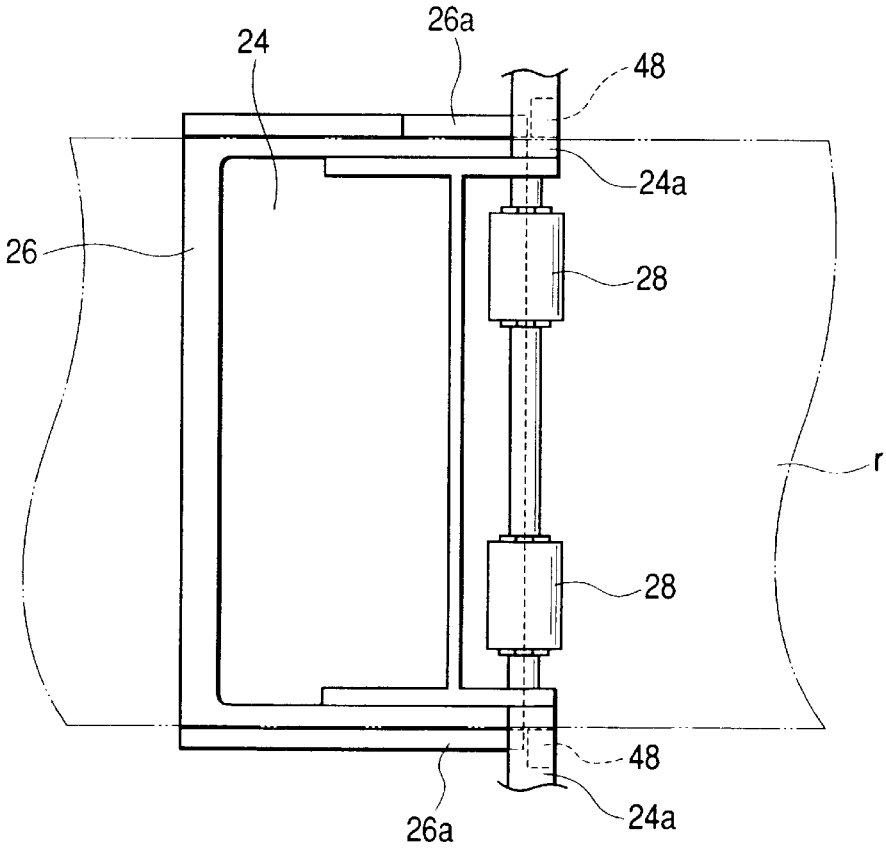
Figure 4:
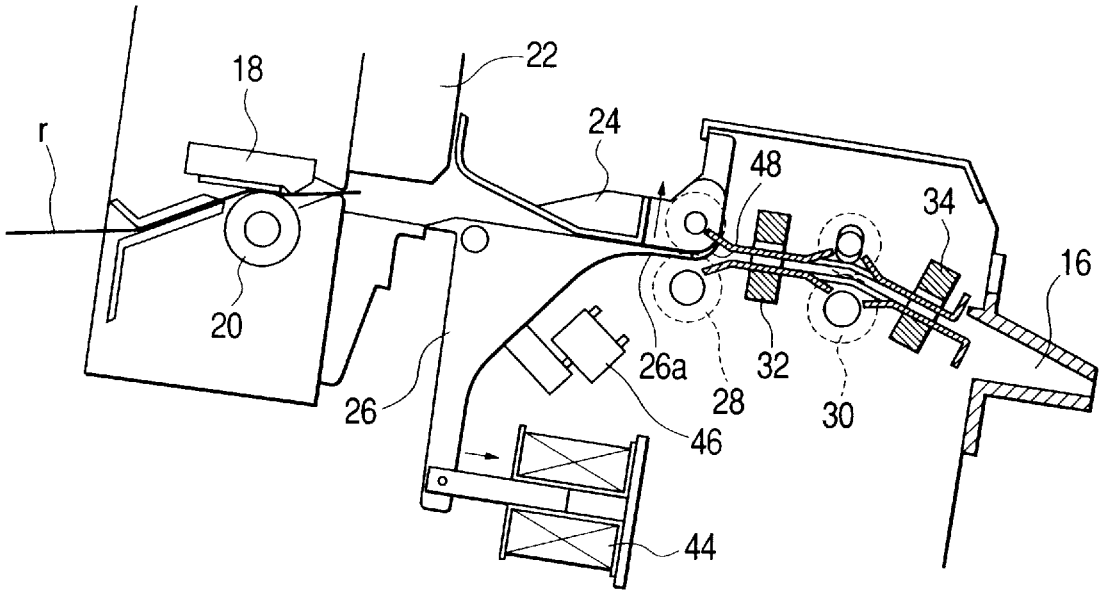
FIGS. 4 to 12 are side views of the inside of the paper discharge unit, and show control steps from printing to discharging rolled paper R in the printer.

FIGS. 3A and 3B respectively are a side view and a plan view showing a lock mechanism of the paper guide 24. As for the lock mechanism of the paper guide 24, a projection 48 is formed on the lower face of a shaft part 24*a* provided on both sides of the paper guide 24. On the other hand, both ends in the width direction of the path switcher 26 exceed the width of the rolled paper R and extend to both sides of the paper R. When the path switcher 26 is rotated both ends of the leading end part 26*a* engage with the projections 48 thereby placing the paper guide 24 in an unrotatable state, namely, locking the paper guide 24.

The paper guide 24 is locked when the leading end r of the rolled paper R is guided into a part below the paper guide 24, as described later. When the paper guide 24 is locked, it is fixed against the force of the leading end r of the rolled paper R pushing it up, thereby making it possible to effectively guide the leading end r of the rolled paper R toward the discharge rollers 28. The control timing and operation later will be described in detail.

Figure 12:
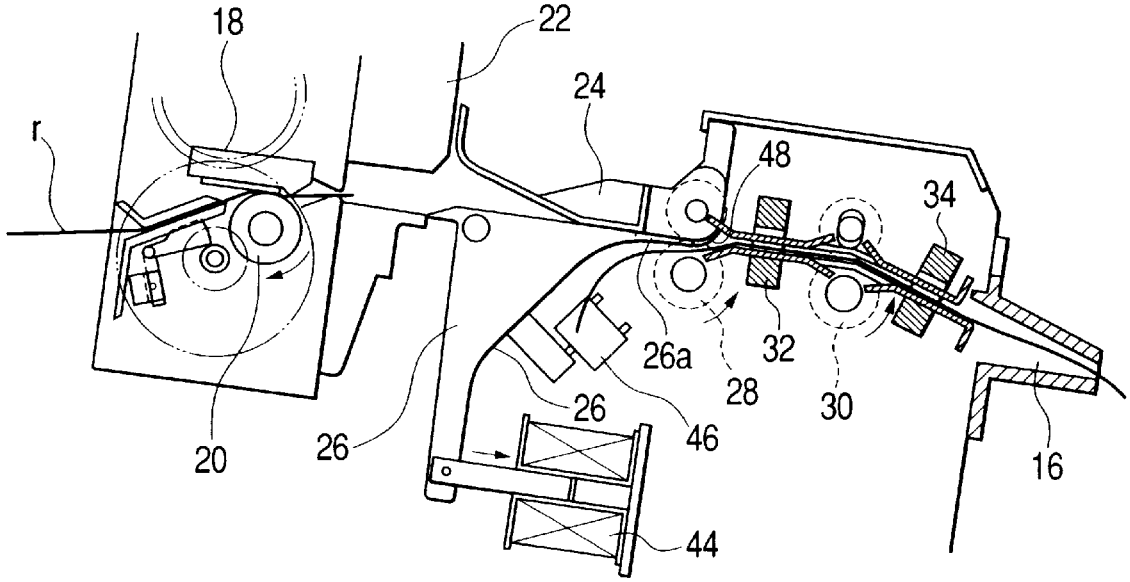
Figure 13:
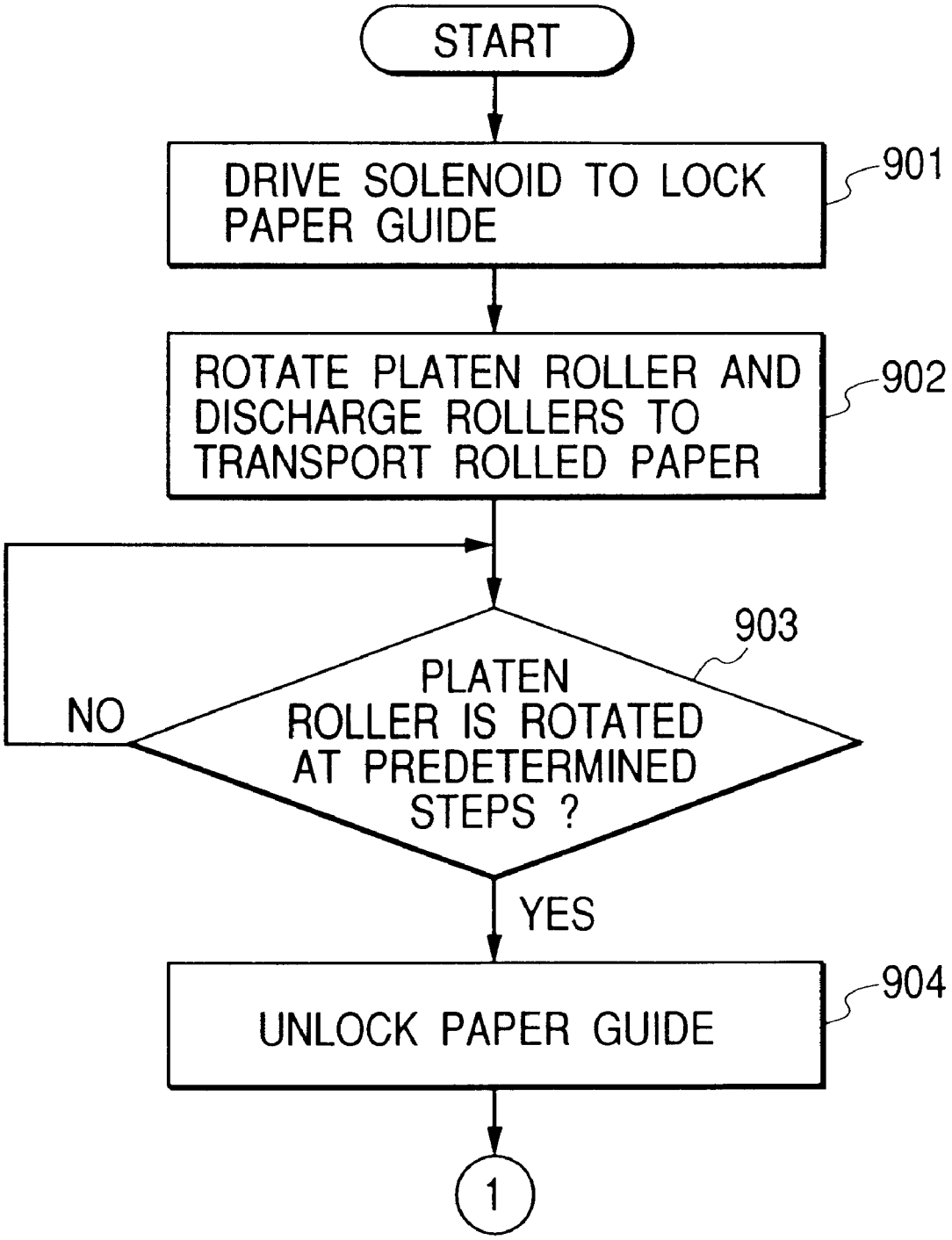
FIGS. 13 and 14 are flowcharts showing the control steps in the printer.
Figure 14:
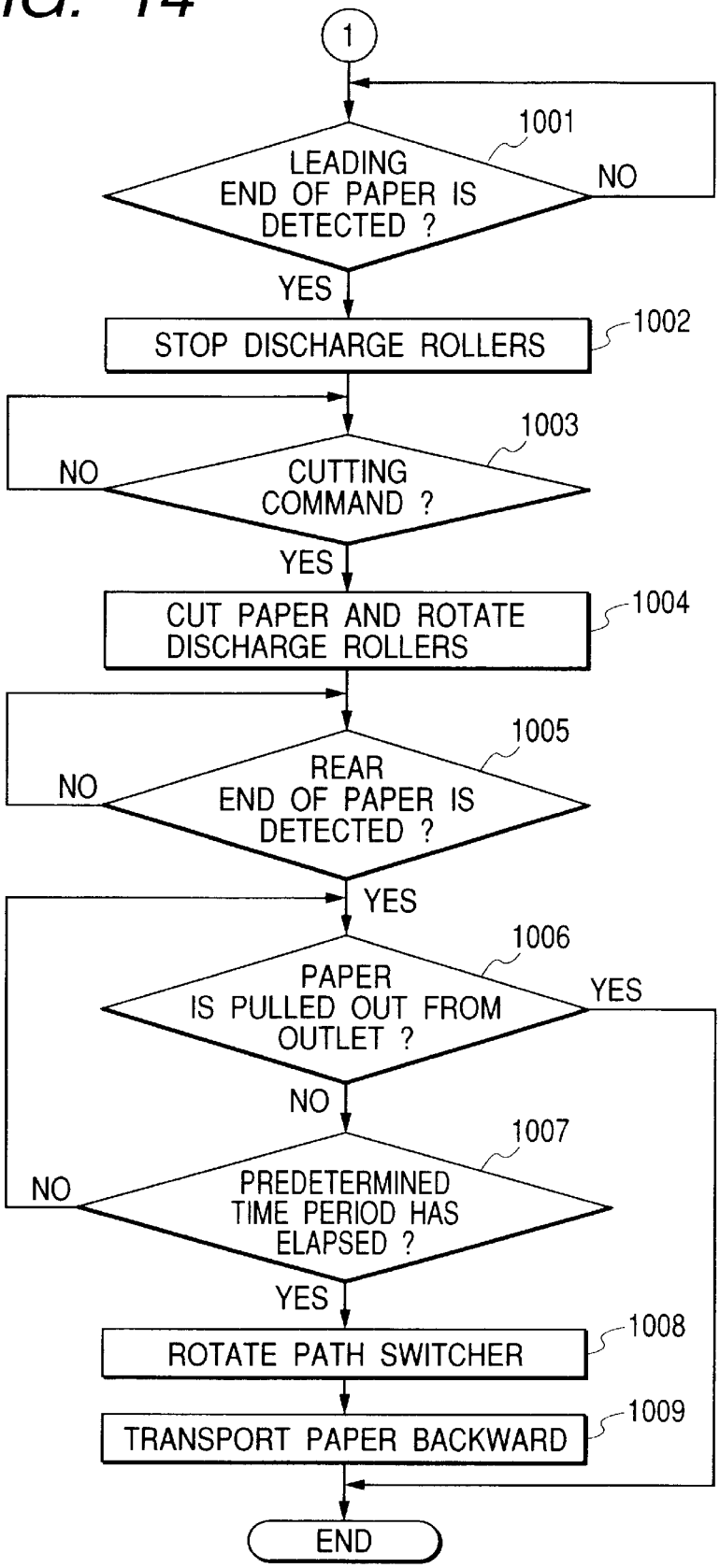

FIGS. 4 to 12 are side views of the inside of the paper discharge unit, and show control steps from print to discharge of rolled paper R in the printer 10 according to the invention. And FIGS. 13 and 14 are flowcharts showing the control steps. Referring to the figures, the control in the printer 10 will be discussed.

Figure 5:
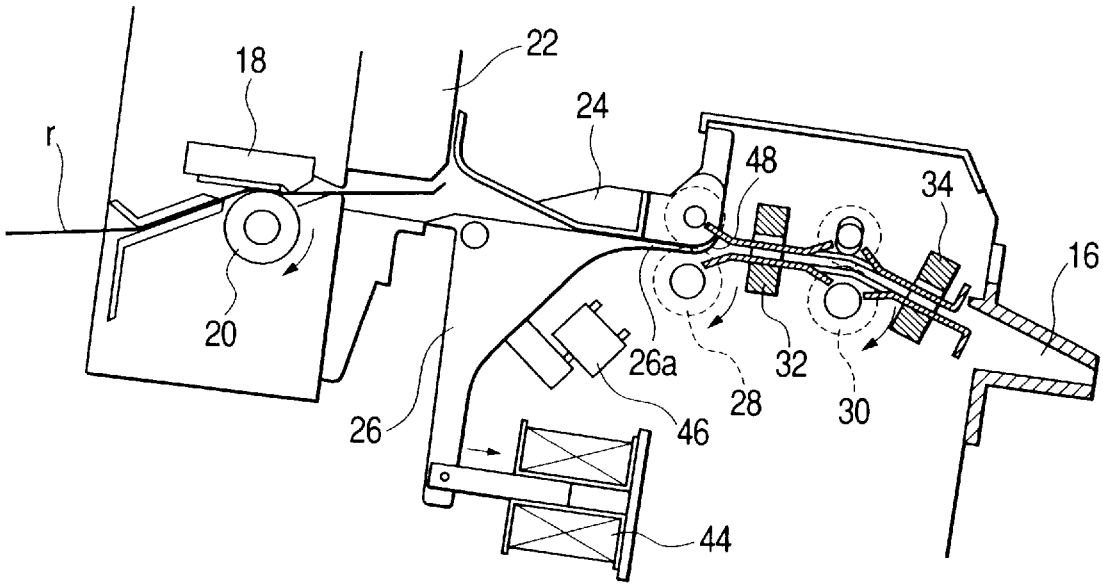
Figure 6:
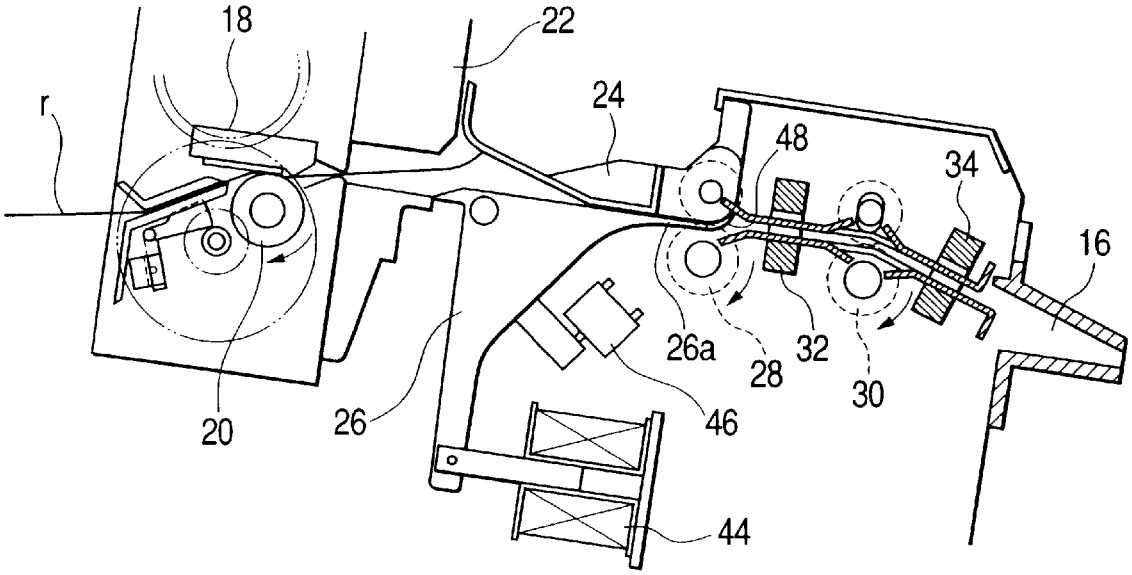
Figure 7:
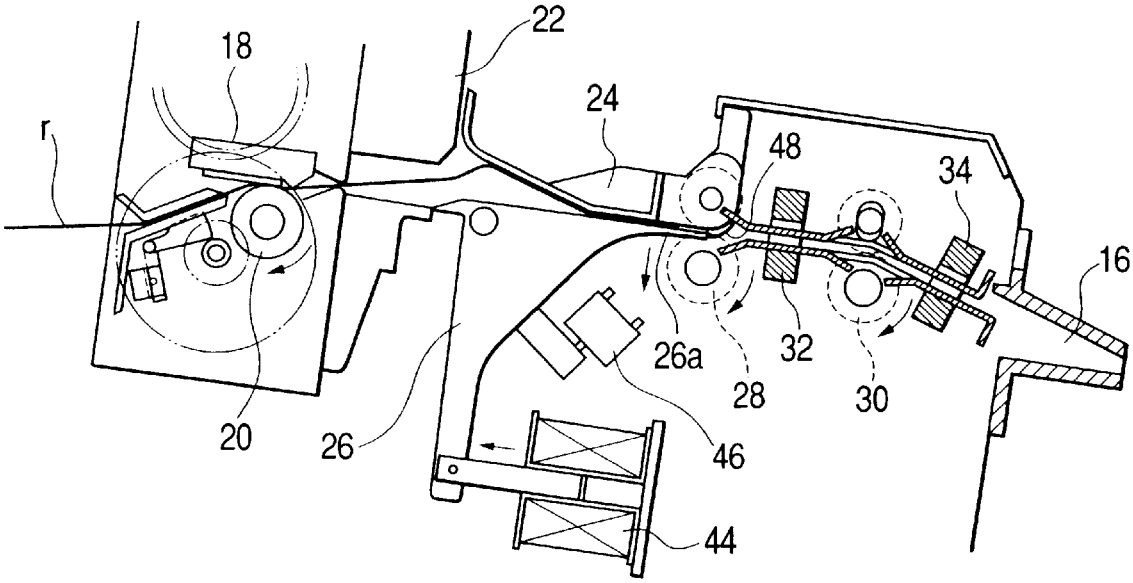

Upon reception of data from the host computer, the printer 10 first stores the data in a buffer, and subsequently interprets the contents of the data by an interpreter provided by the CPU. If the interpreted data is print data, first the paper guide 24 is locked (FIG. 4 and step 901 in FIG. 13) before the printing operation. That is, the solenoid 44 is driven, based on a signal from the CPU, so that the path switcher 26 is rotated and the leading end part 26*a* projects into the movement path of the projection 48 of the paper guide 24. In this state, while the platen roller 20 feeds paper, the CPU controls driving of the print head 18 so that the print head prints on the print surface in accordance with the print data. Then, the CPU drives the discharge rollers 28 and 30 in synchronization with the platen roller 20 (FIG. 5 and step 902). The paper is gradually fed with the print operation, and the leading end r of the paper R arrives at a point between the paper guide 24 and the path switcher 26 in the paper discharge unit 14. Finally, the paper comes in contact with the paper guide 24 as shown in FIG. 6. Then, since the paper guide 24 is locked by the path switcher 26 in advance at step 901, and thus is not lifted up by the force of the leading end r of the paper R, it guides the leading end r of the paper R to the discharge rollers 28. As shown in FIG. 7, when the leading end r of the paper R approaches the discharge rollers 28 thereby eliminating the possibility that the paper guide 24 is lifted up by the force of the leading end of the paper, the path switcher 26 is moved down so that the paper guide 24 is unlocked. That is, the CPU counts the number of steps of the step motor for rotating the platen roller 20, and if the number of steps reaches a predetermined number (step 903), the CPU turns off the solenoid 44, thereby rotating the path switcher 26 so that the leading end part 26*a* moves down. Then, the transport path is opened and, at the same time, the paper guide 24 is unlocked (step 904).

Figure 8:
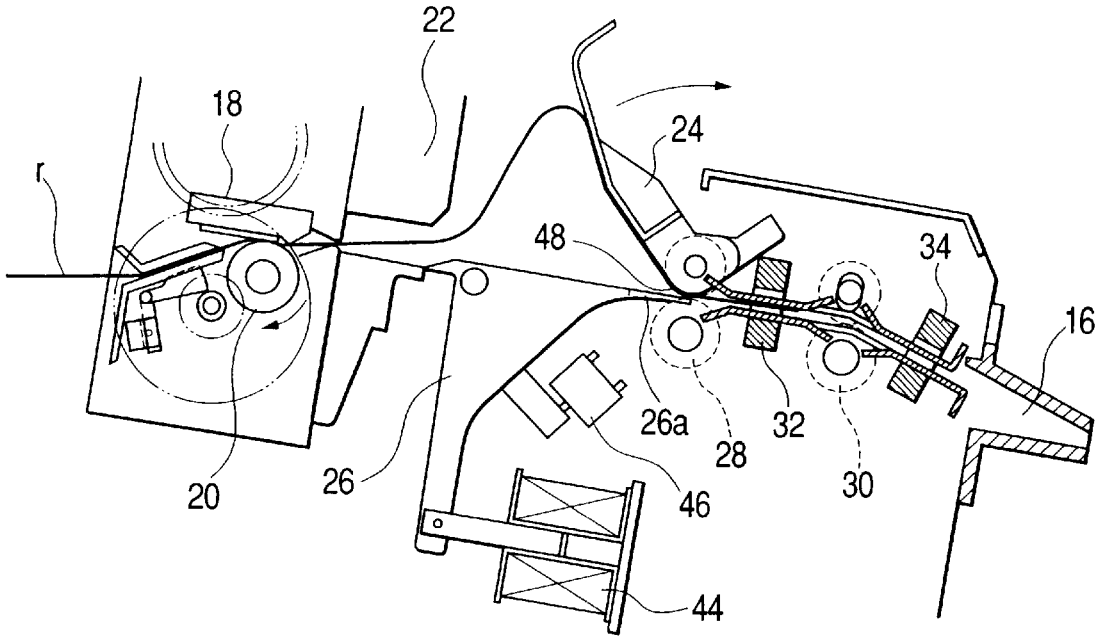

As the transport path is opened, the paper is fed toward the outlet 16 whereby the leading end of the paper reaches the upstream discharge rollers 28 and is further fed downstream by the driving force of the discharge rollers 28. The leading end r of the paper R passes the discharge rollers 28, and the upstream paper sensor 32 (placed downstream from the discharge rollers 28) detects such fact (step 1001 in FIG. 14). Upon reception of a detection signal from the upstream paper sensor 32, the CPU first stops driving the discharge rollers 28 and 30 (step 1002). As the discharge rollers 28 are stopped, the leading end of the paper is placed and held between the discharge rollers 28 . On the other hand, printing is continued at the print head 18, and the platen roller 20 transports paper until completion of printing all print data. Consequently, as shown in FIG. 8, the paper fixed by the discharge rollers 28 is gradually bent and curved like a loop between the cutter mechanism 22 and the discharge rollers 28. At this time, the paper guide 24 is already unlocked and, thus, rotates with formation of the loop without hindering formation of the loop.

Figure 9:
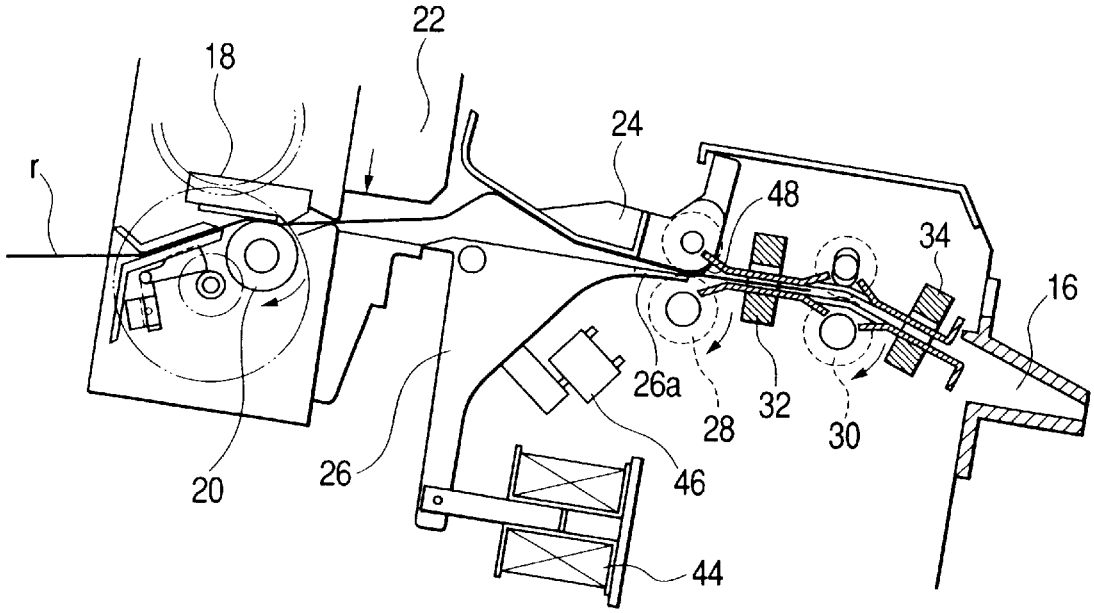
Figure 10:
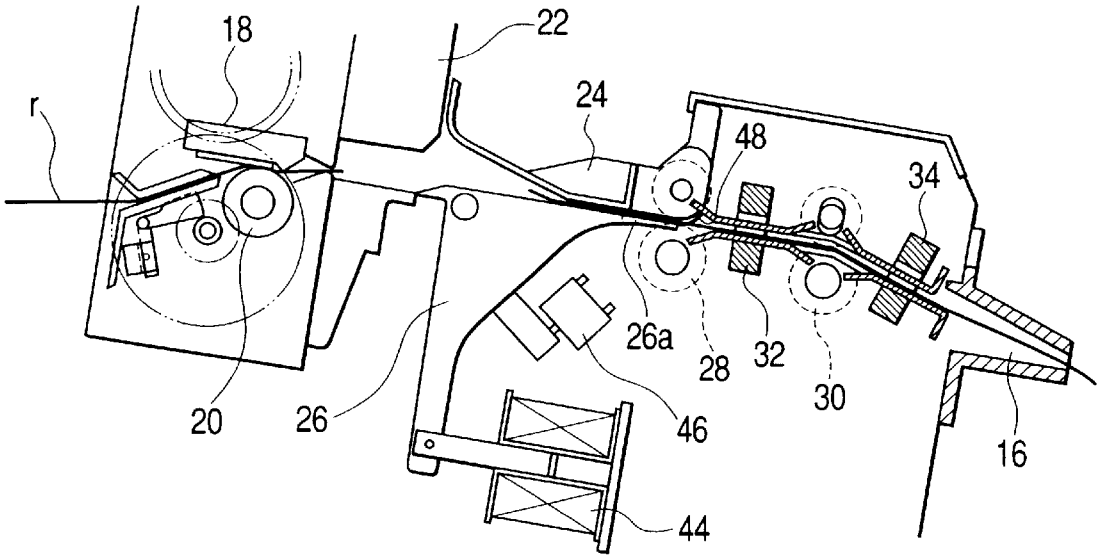
Figure 11:
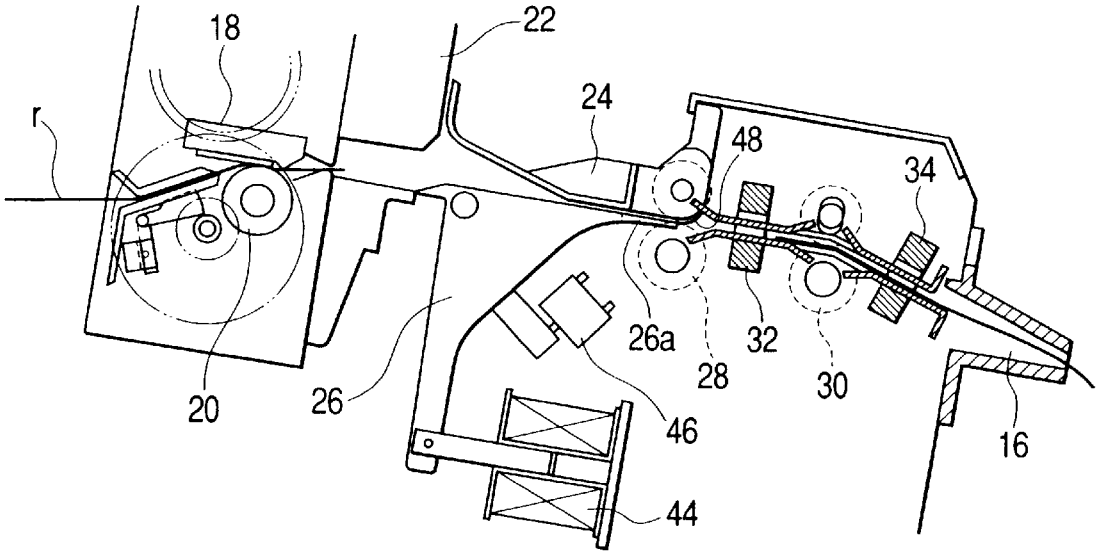

Following the print data concerning one receipt, a cut command for cutting the paper (the command may be a command indicating the print termination of one receipt) is sent from the host computer. At this point in time, the platen roller is stopped. When the cut command is interpreted by the data interpretation section of the CPU (step 1003), the cutter mechanism 22 is driven to cut the paper and separate it from the upstream rolled paper R. Also, driving of the discharge rollers 28 and 30 is restarted (FIG. 9 and step 1004). Consequently, the leading end of the paper r is discharged through is the outlet 16 and, accordingly, the formed loop of the paper is gradually eliminated whereby the paper guide 24 is restored to the initial position (FIG. 10). The fact that the rear end of the cut paper exceeds the upstream paper sensor 32 is detected (FIG. 11 and step 1005), whereupon driving of the discharge rollers 28 and 30 is stopped. Consequently, the rear end part of the cut paper is held weakly on the discharge rollers 30 and can be taken out by the user.

If the user does not take the cut paper out of the outlet 16 within a predetermined time period—namely, if the state does not change for a predetermined time period after the downstream paper sensor 34 senses the cut paper—the printer 10 executes processing for collecting the cut paper in the collection unit 36. If the output state of the downstream paper sensor 34 does not change for a predetermined time period (steps 1006 and 1007), the CPU drives the solenoid 44 to operate the path switcher 26 for opening the collection path 38 to the rear end of the cut paper (step 1008). Next, the discharge rollers 28 and 30 are rotated backward, whereby the cut paper is fed backward and is guided into the collection path 38 (step 1009), as shown in FIG. 12. The cut paper is guided into the collection path 38 by the lower face 26*c* of the path switcher 26, and is collected in the collection tray 40.

Thus, according to the first embodiment, when the leading end r of paper R is guided to the paper guide, rotation of the paper guide is locked, whereas, when paper is curved like a loop, the paper guide is rotated so as to assist the paper's curving motion, whereby if a "peculiarity" or the like occurs at the leading end of the paper, the paper still can be smoothly guided toward the outlet.

In this embodiment, the paper guide 24 is locked by the path switcher 26, but may be locked by any other retention mechanism.

As the print head, various heads of the ink-jet-type, etc., can be adopted in place of the thermal-type print head. Likewise, as the rolled paper R, not only the heat-sensitive paper, but also plain paper, etc., can be adopted. Further, the embodiment can be applied not only to the rolled paper R, but also to paper of various forms that allow a loop to be formed, such as any other continuous paper and long single-cut sheets. Also, the paper discharge unit 14 of this embodiment can be applied to various sheets of films, tape, etc., in place of the rolled paper R.

A regulation member, for regulating the width direction of rolled paper R, can be placed on the portion of the paper guide that faces the transport path (lower face). Since the paper guide is rotated as the paper is transported (and curved like a loop), a part of the paper is always in contact with the lower face of the paper guide. Therefore, and if the paper guide is provided with a regulation member for regulating the width direction of paper, skew of the paper when it is transported can be prevented, so that the paper can be transported stably.

Figure 15:
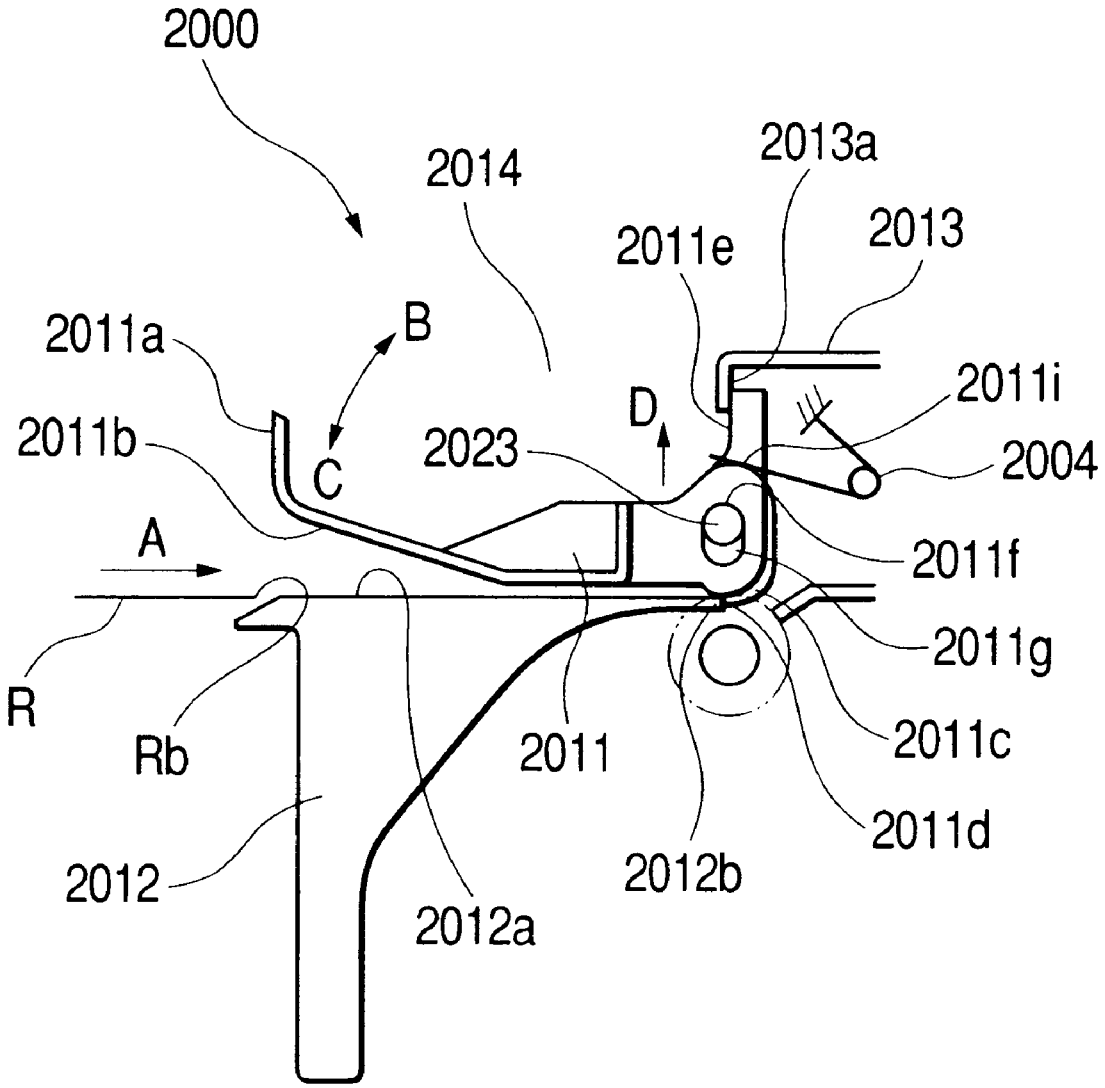
FIG. 15 is a schematic side view showing a paper discharge unit according to a second embodiment of the invention.

Next, a second embodiment of the invention will be discussed. FIG. 15 is a schematic side view showing the internal structure of a paper discharge unit 2000 forming a part of a printer according to the second embodiment of the invention. Other components, such as a print section 12, etc., of the printer are identical with those of the first embodiment shown in FIG. 1 and, therefore, are denoted by the same reference numerals in FIG. 15 and will not be discussed again.

In the paper discharge unit 2000 of this embodiment, fed paper unlocks a paper guide without using an actuator such as a solenoid.

An upper paper guide 2011, forming a part of the paper discharge unit 2000, is rotatably supported by a shaft 2023. The upper paper guide 2011 comprises a shaft slot 2011*g* for receiving the shaft 2023. The shaft slot 2011*g* extends substantially perpendicular to a paper transport direction A (transport path), and is of such a length that the shaft 2023 is able to move therein. The upper paper guide 2011 is urged toward a lower paper guide 2012 by a spring member 2004. The spring member 2004 is a torsion coil spring, which has one end hooked on a claw part 2011*i* of the upper paper guide 2011, and which has an opposite end hooked on a retention plate 2013, for applying a force such that the upper paper guide 2011 and the lower paper guide 2012 are closed to each other.

The lower paper guide 2012 comprises a transport face 2012*a* forming a part of the transport path for the rolled paper R together with the upper paper guide 2011. Further, the lower paper guide 2012 is extended to the vicinity on the center vertical line of the shaft 2023, and is formed with a predetermined thickness as an engagement part 2012*b*. The engagement part 2012*b* engages an engagement part 2011*c*, of the upper paper guide 2011, for forming a lock mechanism that locks the upper paper guide 2011.

When paper does not exist in the lower part of the upper paper guide 2011, the upper paper guide 2011 is stable at a position where the shaft 2023 comes in contact with an upper rounded portion 2011*f* of the shaft slot 2011*g* due to the weight of the upper paper guide 2011, and due to the approach force of the spring member 2004. Also, in this state, an engagement face 2011*d* of the engagement part 2011*c* is brought into contact with the engagement part 2012*b* of the lower paper guide 2012. Therefore, in this state, the upper paper guide 2011 is prevented from rotation in a B direction (i.e., it is in a locked state). Further, in this state, an end part 2011*e* of the upper paper guide 2011 is brought into contact with a face 2013*a* of the retention plate 2013 and is prevented from rotation in a C direction.

A space 2014, for allowing the upper paper guide 2011 to be rotated in the B direction and for storing curved paper, is provided above the upper paper guide 2011.

Figure 16A:
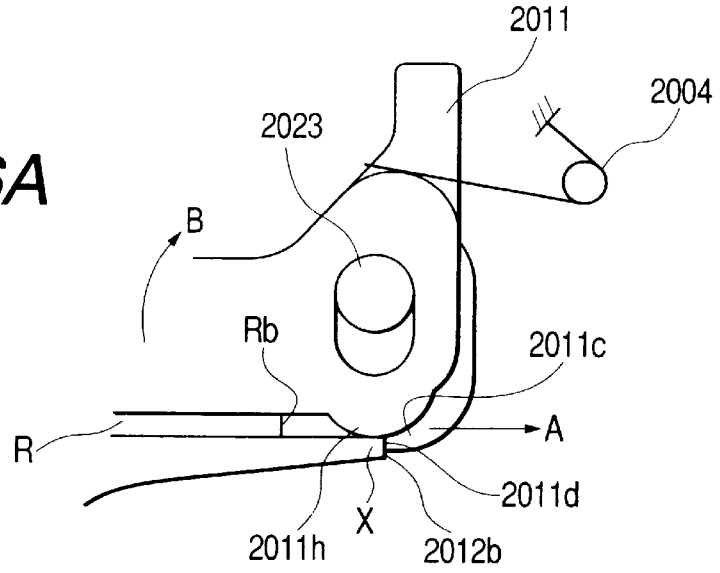
FIGS. 16A to 16C are schematic representations showing the operation of the paper discharge unit of FIG. 15.

As shown in FIGS. 15 and 16A, as a platen roller 20 is rotated, a leading end Rb of the rolled paper R is transported along the transport path formed between the upper paper guide 2011 and the lower paper guide 2012. The rolled paper leading end Rb is first brought into contact with a slope 2011*b* of the upper paper guide 2011. At this time, the rolled paper leading end Rb presses the slope 2011*b* so as to attempt to rotate the slope 2011*b* in the B direction, but the upper paper guide 2011 is locked as described above so that it is prevented from rotation in the B direction. Thus, the rolled paper R reliably is guided to the transport rollers 28 regardless of the strength of the winding peculiarity of the rolled paper R, the strength of firmness, or the roll winding direction. At this time, a convex part 2011*h* of the upper paper guide 2011, and a transport face 2012*a* of the lower paper guide 2012, are in contact with each other at a position X.

Figure 16B:
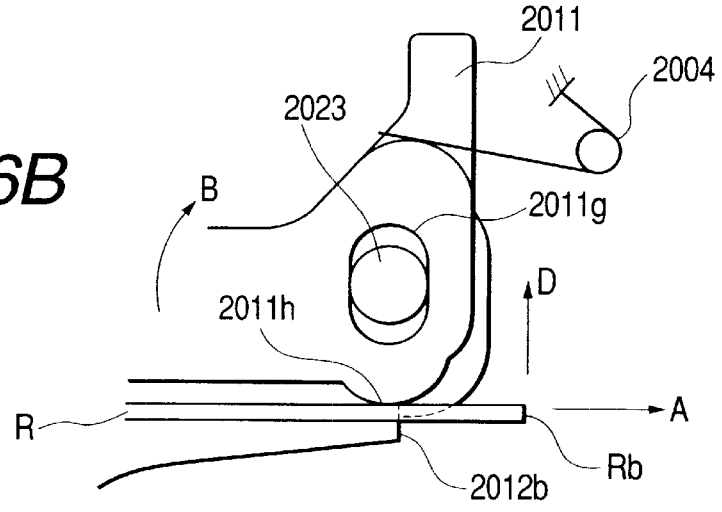
Figure 16C:
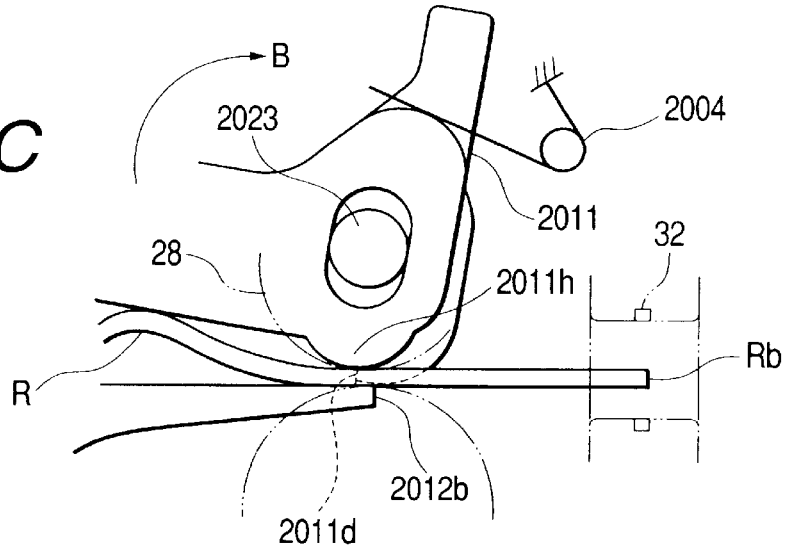
Figure 17:
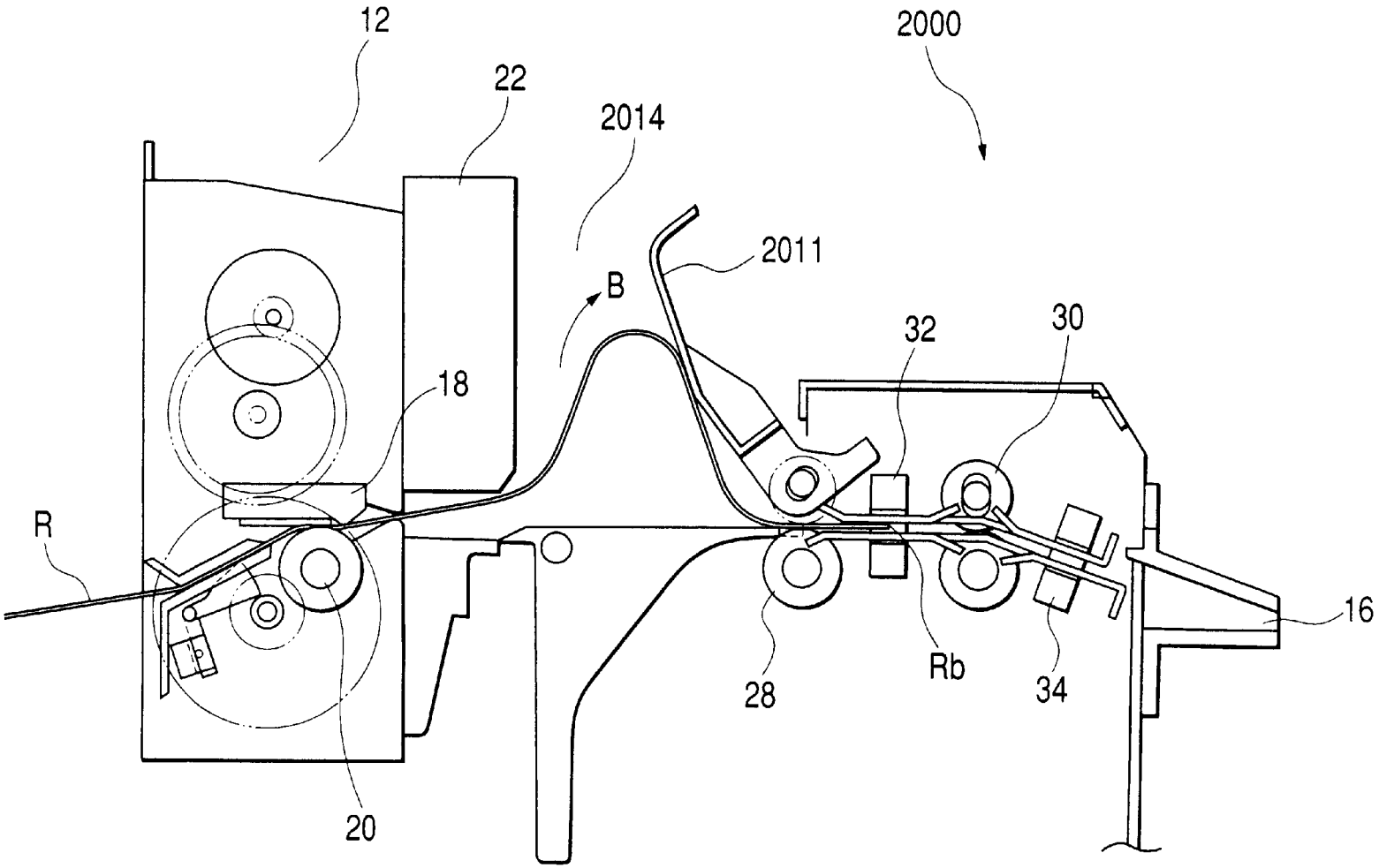
FIG. 17 is a schematic drawing showing the rolled paper curving operation in the printer of FIG. 15.

When the rolled paper R is further transported so that the leading end Rb reaches the position X, the rolled paper R enters the nip between the convex part 2011*h* and the transport face 2012*a* as shown in FIG. 16B. The amount of overlap of the engagement face 2011*d* and the engagement part 2012*b* is set to a value smaller than the thickness of the rolled paper R. Thus, as the rolled paper R enters the nip, the upper paper guide 2011 moves in a D direction along the shaft slot 2011*g*, and consequently the abutment state of the engagement part 2011*c* and the engagement part 2012*b* is released. That is, as shown in FIG. 16C, the prevention of rotation of the upper paper guide 2011 in the B direction is released (i.e., the paper guide 2011 is unlocked) and the transport path formed by the upper paper guide 2011 is opened. Thus, as shown in FIG. 17, when the upper paper guide 2011 is unlocked, the rolled paper R advances so as to push the upper paper guide 2011 in the B direction, and so as to curve like a loop in the space 2014, as in the first embodiment.

As in the first embodiment, after the printing operation is terminated, the paper is cut by a cutter mechanism 22 and the cut paper is discharged through an outlet 16. As the rear end of the cut paper passes through the engagement part 2011*c* of the upper paper guide 2011, the upper paper guide 2011 is urged toward the lower paper guide 2012 due to the weight of the upper paper guide 2011, and due to the spring member 2004, whereby the upper paper guide 2011 is restored to its initial position, and again is placed in a locked state.

Thus, according to the second embodiment, the transported paper itself can automatically switch the locking and unlocking of the upper paper guide, so that a drive source for such purpose is not required, whereby the paper guide lock mechanism can be realized as a simple structure.

In this embodiment, the upper paper guide is moved to guide and curve the paper, but this embodiment is not limited to moving the upper paper guide if another member has the same function. Further, the upper paper guide is rotated, but this embodiment is not limited to rotate the upper paper guide if at least one of the members bearing a record paper guide can be moved. The engagement state of the upper paper guide and the lower paper guide is held by the weight of the upper paper guide and the spring member, but a weighting member, etc., can also be added in place of the spring member. Further, a shaft may be fixed to the upper paper guide, and may be rotatably supported by a support member.

Figure 18:
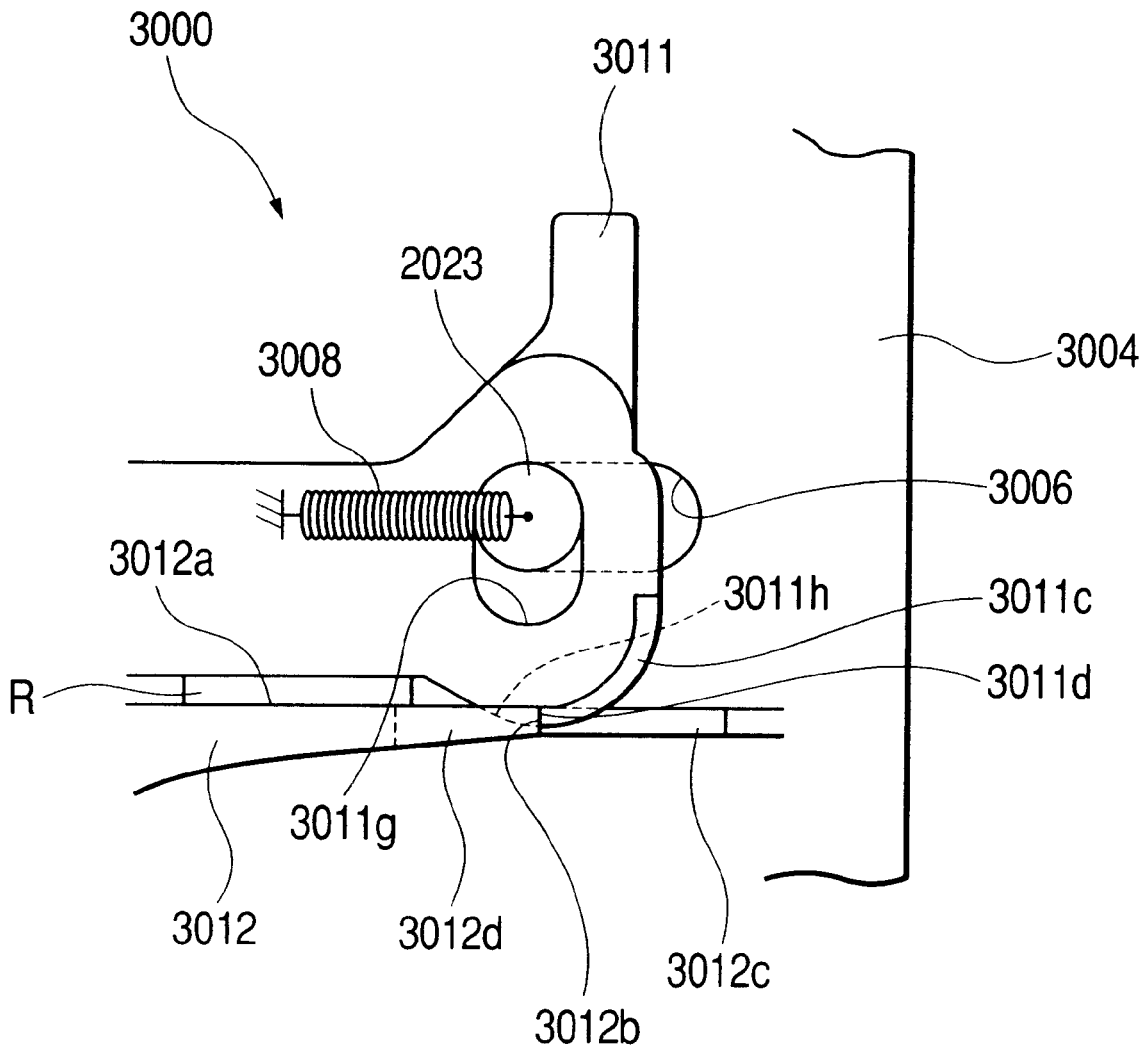
FIG. 18 is a schematic side view showing a paper discharge unit according to a third embodiment of the invention.

Next, a third embodiment of the invention will be discussed with reference to the accompanying drawings. FIG. 18 is a schematic side view showing the internal structure of a paper discharge unit 3000 forming a part of a printer according to the third embodiment of the invention. Other components, such as a print section 12, etc., of the printer are identical with those of the first embodiment shown in FIG. 1 and, therefore, are denoted by the same reference numerals in FIG. 18 and will not be discussed again. Components identical with those of the second embodiment shown in FIG. 15 are denoted by the same reference numerals in FIG. 18 and, therefore, will not be discussed again.

The paper discharge unit 3000 of this embodiment is a modified embodiment of the paper discharge unit 2000 of the second embodiment, and differs from the paper discharge unit 2000 in that it includes a structure in which an upper paper guide 3011 can be unlocked regardless of the thickness of rolled paper, and also includes a structure for preventing damage to the upper paper guide 3011 or to a lower paper guide 3012 that can occur when an operator attempts to open the upper paper guide 3011 when it is placed in a locked state.

The paper discharge unit 3000 comprises a frame member 3004 for supporting a shaft 2023 on which the upper paper guide 3011 is rotated. The frame member 3004 is formed with a slot 3006 serving as a bearing for the shaft 2023. The slot 3006 is formed along the transport direction of the rolled paper R (substantially parallel with a transport path) and supports the shaft 2023 so that the shaft 2023 can be advanced and retreated. The shaft 2023 is urged in an upstream direction by a spring member 3008. The spring member 3008 is an extension spring, which has one end hooked on the shaft 2023 and an opposite end hooked on the frame member 3004.

The upper paper guide 3011 is formed with a shaft slot 3011*g* as in the second embodiment (see FIG. 15), and is supported on the shaft 2023 via the shaft slot 3011*g*. In FIG. 18, the spring member 2004, as in FIG. 15, is not shown.

The upper paper guide 3011 is provided with an engagement part 3011*c* for engaging with the lower paper guide 3012, thereby locking the upper paper guide 3011. The engagement part 3011*c* is protruded from a lower downstream side (lower right in the figure) of a side face of the upper paper guide 3011 in an axial direction of the shaft 2023. An engagement face 3011*d*, to be abutted by an engagement face 3012*b* of the lower paper guide 3012 (described later), is provided at a rear end part of the engagement part 3011*c*. That is, the engagement part 3011*c* is formed along the outer shape of a convex part 3011*h* corresponding to the convex part 2011*h* in the second embodiment (see FIG. 16) without projecting from the outer periphery of the convex part 3011*h*.

The lower paper guide 3012 is formed with a recessed part 3012*c* for housing the convex part 3011*h*, and the lower part of the engagement part 3011*c*, so that the lower part of the upper paper guide 3011 is placed below a transport face 3012*a*. The engagement part 3012*d* is provided as a part of an upstream side wall of four side walls forming the recessed part 3012*c*. A part of the upstream side wall serves as the engagement face 3012*b* which is to be brought into contact with the engagement face 3011*d* of the engagement part 3011*c*.

In this embodiment, the recessed part 3012*c* is provided as a single recess for housing the convex part 3011*h* and the lower part of the engagement part 3011*c* therein. Instead, there may be configured that individual recessed parts for housing the convex part 3011*c* and the lower part of the engagement part 3011*c* respectively therein are formed.

The engagement face 3011*d* is brought into contact with the engagement face 3012*b* in a state wherein the convex part 3011*h* is housed in the recessed part 3012*c*. As the engagement face 3011*d* is brought into contact with the engagement face 3012*b*, the upper paper guide 3011 is prevented from rotation in the clockwise direction as shown in FIG. 18. That is, the engagement face 3011*d* is brought into contact with the engagement face 3012*b*, whereby the upper paper guide 3011 is locked.

When the rolled paper R enters a nip between the upper paper guide 3011 and the lower paper guide 3012, the upper paper guide 3011 is unlocked. Specifically, the convex part 3011*h* of the upper paper guide 3011 is lifted up by the leading end part of the rolled paper R that enters the nip, and the abutment state of the engagement face 3011*d* and the engagement face 3012*b* is released, whereby the upper paper guide 3011 is unlocked. Here, the convex part 3011*h* serves as an engagement releaser.

Thus, since the position at which the upper paper guide 3011 engages with the lower paper guide 3012 is flush with the transport face 3012*a* of the lower paper guide 3012 or below the transport face 3012*a*, and since the engagement part 3011*c* is formed along the outer shape of the convex part 3011*h* without projecting therefrom, the upper paper guide 3011 can be reliably unlocked as the rolled paper R of an arbitrary thickness enters the nip between the upper paper guide 3011 and the lower paper guide 3012, regardless of the overlap dimension of the engagement face 3011*d* and the engagement face 3012*b*.

Next, a user-performed operation for opening the upper paper guide 3011 will be discussed with reference to FIGS. 19A to 19C. For example, when a paper jam occurs in the vicinity of the upper paper guide 3011, the user-performed operation is executed to open the upper paper guide 3011 and remove the paper jam.

Figure 19A:
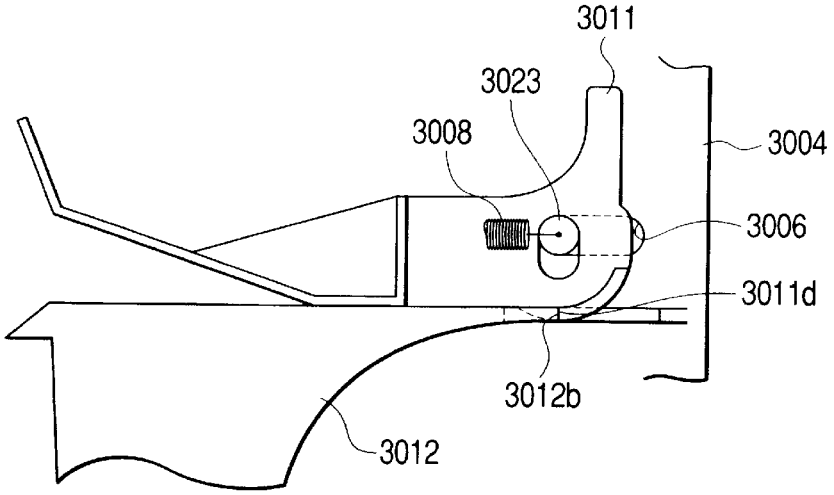
FIGS. 19A to 19C are schematic representations showing the operation of the paper discharge unit of FIG. 18.
Figure 19B:
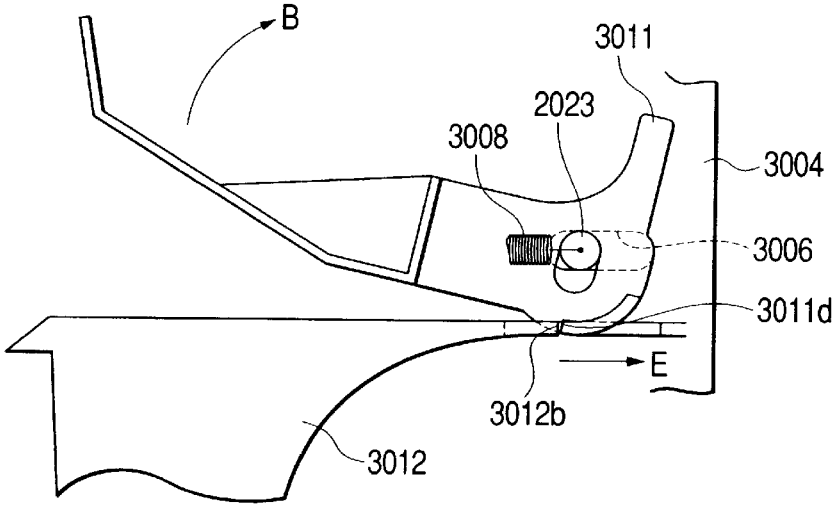

FIG. 19A shows a state in which the engagement face 3011*d* of the upper paper guide 3011 is brought into contact with the engagement face 3012*b* of the lower paper guide 3012 so as to lock the upper paper guide 3011. In this locked state, if a force attempting to open the upper side of the transport path is applied, the upper paper guide 3011 starts to rotate in the B direction, as shown in FIG. 19B. The upper paper guide 3011 rotates as the shaft 2023 moves in a downstream direction (E direction) along the slot 3006 with the contact between the engagement face 3011*d* and the engagement face 3012*b* as a fulcrum. As the shaft 2023 moves, the force applied to form a nip between the engagement face 3011*d* and the engagement face 3012*b* is reduced. Because the shaft 2023 receives a force—in a direction of restoring the shaft 2023 to the former position, namely, the position in the locked state (see FIG. 19A)—by the spring member 3008, the contact between the engagement face 3011*d* and the engagement face 3012*b* is not immediately released.

Figure 19C:
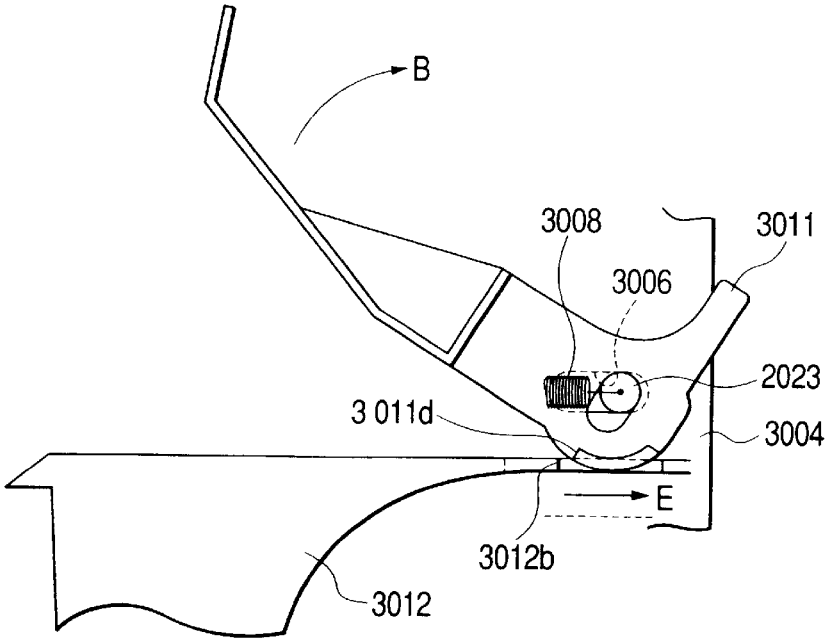

As shown in FIG. 19C, as the upper paper guide 3011 further rotates in the B direction, the shaft 2023 also moves to a further downstream area in the slot 3006. Then, the engagement face 3011*d* and the engagement face 3012*b* are brought out of contact with each other, whereby the upper paper guide 3011 is unlocked and can be rotated.

Thus, if a force attempting to open the transport path is applied to the upper paper guide 3011, the shaft 2023 is displaced downward, thereby relieving the force acting on the nip between the engagement face 3011*d* and the engagement face 3012*b*. Thus, to open the locked upper paper guide 3011 for maintenance purposes or the like, damage to the upper paper guide 3011 or the lower paper guide 3012 reliably can be prevented, and the maintenance work can be facilitated.

The force tending to restore the upper paper guide 3011 to the locked state is applied to the upper paper guide 3011 by the spring member 3008. Thus, if the upper paper guide 3011 is locked, rolled paper can be guided reliably by the upper paper guide 3011.

In this embodiment, the slot 3006 is formed along the rolled paper transport direction, but the shape and position of the slot 3006 can be changed as desired in response to the positional relationship between the shaft 2023 and the engagement face 3011*d*, etc. When the shaft 2023 moves, the shaft slot 3011*g* of the upper paper guide 3011 may be displaced relative to the shaft 2023. Further, for example, urging members using a fluid pressure, an electromagnetic force, or the like, may be used in place of the spring member 3008 (spring member 2004). Moreover, a structure for moving the upper paper guide 3011 relative to the shaft 2023, in place of moving the shaft 2023, may be adopted. Also, the structure making it possible to displace the shaft 2023 may be applied to the paper discharge unit of the first embodiment.

The paper guide lock mechanism may be provided at both, or either one of, the ends in the paper width direction. In this case, the structure for displacing the shaft 2023 may be provided only on the side where the lock mechanism exists.

The present invention is not limited to the specific above-described embodiments. It is contemplated that numerous modifications may be made to the print-medium transport unit of the present invention without departing from the spirit and scope of the invention as defined in the following claims.

What is claimed is:

1. A transport unit, for transporting a print medium, comprising:

a guide member, that forms at least a part of a transport path through which the print medium is transported;

a support member, that supports the guide member so as to be movable by a force of the print medium between a first position at which the guide member forms the transport path and a second position at which the guide member opens the transport path; and a lock member, which locks the support member at the first position.

2. The transport unit as set forth in claim 1, further comprising a moving mechanism, that moves at least one of the guide member and the lock member between a third position and a fourth position;

wherein the guide member includes a first engagement member, and the lock member includes a second engagement member; and wherein the first engagement member and the second engagement member are engaged with each other at the third position, and are separated from each other at the fourth position.

3. The transport unit as set forth in claim 2, wherein the support member rotatably supports the guide member such that a portion of the guide member placed in an upstream side of the transport path opens the transport path.

4. The transport unit as set form in claim 3, wherein:

the lock member is arranged so as to face the guide member thereby forming the transport path together with the guide member;

the guide member is formed with a first slot that extends in a direction substantially perpendicular to the transport path;

the support member includes a shaft member which is engaged with the first slot to rotatably support the guide member; and the moving mechanism includes the first slot and the shaft member.

5. The transport unit as set forth in claim 4, wherein the moving mechanism further includes a first urging member that urges the guide member toward the lock member.

6. The transport unit as set forth in claim 4, wherein:

a gap is formed between the guide member and the lock member at the third position such that the narrowest part of the gap is narrower than a thickness dimension of the print medium; and an engagement margin is provided, between the first engagement member and the second engagement member at the third position, so as to be smaller than the thickness dimension of the print medium.

7. The transport unit as set forth in claim 4 wherein:

the guide member includes an engagement releaser that is protruded toward the transport path;

the first engagement member is formed on the guide member so as not to be protruded from an outer peripheral face of the engagement releaser;

the lock member is formed with a recess which houses the engagement releaser and the first engagement member, said recess being formed with side walls; and the second engagement member is provided as one of the side walls forming the recess.

8. The transport unit as set form in claim 4, wherein:

the guide member includes an engagement releaser that is protruded toward the transport path;

the first engagement member is formed on the guide member so as not to be protruded from an outer peripheral face of the engagement releaser;

the lock member is formed with a first housing member which houses the engagement releaser, and a second housing member which houses the first engagement member; and the second engagement member is provided as one of side walls formed with the second housing member.

9. The transport unit as set forth in claim 2, wherein:

the first engagement member is provided as a pair of engagement members arranged on the guide member at both widthwise sides of the print medium; and the second engagement member is provided as a pair of engagement members arranged on the lock member at both widthwise sides of the print medium.

10. The transport unit as set forth in claim 2, further comprising:

an outlet, from which the print medium is discharged;

a first transport roller, which transports the print medium toward the outlet, in the transport path at a downstream side of the guide member;

a controller, which controls the moving mechanism to move said at least one of the guide member and the lock member toward the third position to lock the guide member, when a leading end of the print medium reaches the guide member, and which controls the moving mechanism to move said at least one of the guide member and the lock member toward the fourth position to unlock the guide member, when the leading end of the print medium reaches in the vicinity of the first transport roller.

11. The transport unit as set forth in claim 10, further comprising a second transport roller, which transports the print medium toward the guide member, in the transport path at an upstream side of the guide member, wherein the controller determines a timing to move said at least one of the guide member and the lock member based on a rotation amount of the second transport roller.

12. A control method, used in the transport unit as set forth in claim 11, comprising the steps of:

rotating the second transport roller to transport the print medium;

driving the lock member to lock the guide member; and driving the lock member to unlock the guide member, when the leading end of the print medium reaches in the vicinity of the first transport roller.

13. A computer program, executed by the controller in the transport unit as set forth in claim 11, comprising the steps of:

rotating the second transport roller to transport the print medium;

driving the lock member to lock the guide member; and driving the lock member to unlock the guide member, when the leading end of the print medium reaches in the vicinity of the first transport roller.

14. The transport unit as set form in claim 10, wherein:

the lock member is rotatably supported at the upstream side of the first transport roller; and the lock member includes a path switcher that is placed in the transport path to lead a rear end of the print medium toward another transport path, when the first transport roller transports the print medium backward.

15. The transport unit as set forth in claim 3, further comprising a reliever that moves the guide member through use of a force acting between the first engagement member and the second engagement member to rotate the guide member when the first and second engagement members are placed in the third position, wherein the reliever moves the guide member by displacing a shaft member toward a downstream side of the transport path.

16. The transport unit as set forth in claim 15, wherein the reliever is formed with a bearing member that supports the shaft member movably therein.

17. The transport unit as set forth in claim 16, wherein the bearing member is provided as a second slot that extends in substantially parallel with the transport path.

18. The transport unit as set forth in claim 15, wherein the reliever includes a second urging member that urges the first engagement member toward the third position.

19. The transport unit as set forth in claim 1, wherein the print medium is provided as continuous paper.

20. A printer comprising the transport unit as set forth in claim 1.

* * * * *